US007971819B2

(12) United States Patent
Marangoni

(10) Patent No.: US 7,971,819 B2
(45) Date of Patent: Jul. 5, 2011

(54) WIRE DEPOSITING APPARATUS

(75) Inventor: Gianluigi Marangoni, Vicenza (IT)

(73) Assignee: Gimax S.R.L., Sovizzo (VI) (IT)

( * ) Notice: Subject to any disclaimer, the term of this patent is extended or adjusted under 35 U.S.C. 154(b) by 701 days.

(21) Appl. No.: 11/989,149

(22) PCT Filed: Jul. 26, 2006

(86) PCT No.: PCT/EP2006/007379

§ 371 (c)(1),
(2), (4) Date: Jan. 22, 2008

(87) PCT Pub. No.: WO2007/012476

PCT Pub. Date: Feb. 1, 2007

(65) Prior Publication Data

US 2010/0127111 A1 May 27, 2010

(30) Foreign Application Priority Data

Jul. 28, 2005 (IT) ..... VI2005A0215

(51) Int. Cl.
*B21C 47/14* (2006.01)
*B65H 54/80* (2006.01)

(52) U.S. Cl. ..... 242/361.4

(58) Field of Classification Search ..... 242/360–363
See application file for complete search history.

(56) References Cited

U.S. PATENT DOCUMENTS

| | | | | |
|---|---|---|---|---|
| 3,143,314 | A * | 8/1964 | Bosco | 242/361.5 |
| 4,669,676 | A * | 6/1987 | Vehling | 242/361.3 |
| 6,019,303 | A * | 2/2000 | Cooper | 242/361.4 |
| 6,260,781 | B1 * | 7/2001 | Cooper | 242/361.4 |
| 7,004,419 | B2 * | 2/2006 | Hsu | 242/361.4 |
| 2005/0023401 | A1 | 2/2005 | Hsu | |

FOREIGN PATENT DOCUMENTS

| | | | |
|---|---|---|---|
| DE | 33 47 031 | A1 | 11/1984 |
| DE | 20 2006 006648 | U1 | 7/2006 |
| EP | 0 199 935 | A2 | 11/1986 |

OTHER PUBLICATIONS

International Search Report.

* cited by examiner

*Primary Examiner* — William E Dondero
(74) *Attorney, Agent, or Firm* — Bucknam & Archer

(57) ABSTRACT

A wire depositing apparatus of the type providing for deposition of the wire, such as welding wire, steel wire with low carbon content, stainless steel wire, core wire or aluminum wire wrapped in a loop, inside a drum. The wire depositing apparatus consists essentially of two parts and more precisely a first part wherein are positioned the capstans for driving and drawing the wire, as well as a device, known as a flyer, which provides for depositing and winding the wire inside the drum. The drum to be filled with the wound wire is set and manipulated in the second part of the depositing apparatus. The flyer, in addition to a rotation movement about its vertical axis, is provided with a vertical reciprocating rectilinear movement.

14 Claims, 9 Drawing Sheets

WIRE DEPOSITING APPARATUS

The present invention relates to a wire depositing apparatus. As is well known, a method for transporting wire used in industry, such as welding wire, wire with low carbon content, stainless steel wire, core wire or aluminum wire, foresees the use of drums inside which the wire is wrapped in a loop. The machine intended to carry out this task, which provides for depositing the wire inside the drum, by winding it in a loop and known by the name depositing apparatus, has a structure that can essentially be divided into two parts:

- a fixed part wherein are positioned the capstans for driving and drawing the wire, taken from an unwinder, arranged upstream of the machine itself, a series of wire rectifiers and the device, known as a «flyer» that, being provided with a rotation movement, provides for depositing and winding the wire inside the drum;
- a vertically mobile part, above which the drum to be filled with the wound wire is set.

The drum, mounted on a platform, is allowed to rotate about its vertical axis eccentrically with respect to the vertical rotation axis of the flyer, which leads the wire to deposit inside the drum, forming a loop, where the wire is wrapped according to a configuration known as «rose». From the operational point of view, at the starting of the winding of the wire, the platform on which the empty drum is set automatically lifts up, commanded by a sensor, such as a photocell or a completely different device suitable for this specific purpose, arranged laterally with respect to the cylindrical wall of the flyer, until the inner base of said drum almost comes into contact with the bottom end of the flyer. Then the machine starts up, allowing the flyer to turn, from which the wire to be wound comes out, whereas the platform starts to go down slowly, as the loop of wound wire inside the drum increases in thickness, always commanded by said sensor. The platform is equipped with a vibrator, which allows regular packing of the wire during winding in a loop. When the winding of the wire is complete, the platform, with the loop inside of it having reached its maximum thickness, positions itself so that it is once again totally lowered and aligned with an outer winding machine, which allows it to be unloaded. The embodiment of known depositing apparatuses, in other words with the flyer revolving in a fixed position and the platform vertically mobile, has numerous drawbacks, deriving from the difficulty of commanding and balancing the moving members. In this case, the flyer, inside of which runs the wire to be wound in a loop and that comes out from its bottom part, consists of a steel cylinder with a large diameter, which spins at a very high peripheral speed; as a result of this, in order to avoid vibrations that compromise the good outcome of the «rose-formation», in addition to limiting the rotation speed of the flyer, the latter must be applied onto a very solid support frame, all of this resulting in a limited productivity and the need to make a complex metallic structure and taking up a substantial bulk. Moreover, as the mobile platform is mounted cantilevered and has to support the considerable weight of the drum that, once filled with the wound wire, can even weigh over 350 kilos, it must in turn be built very solidly and applied to a column, which must be made using an equally strong metallic structure and a substantial bulk. Basically, all of this results in a depositing apparatus being made involving complex manufacturing steps, considerable sizes, high costs and limited productivity. The purpose of the present invention is to make a depositing apparatus that does not haven the drawbacks or similar known machines. Said purpose is obtained with a depositing apparatus, characterised in that it foresees that the flyer, in addition to the rotation movement around its vertical axis, is provided with a vertical reciprocating rectilinear movement, so that it can adapt to the progressive increase in thickness of the loop of wound wire whereas, on the other hand, the platform, which acts as a bearing base, is fixed, in its lowest position, aligned with the winding machine for loading/unloading the drum. The invention also foresees a special configuration of the flyer characterised in that it has a considerably lighter structure, consisting of a casing, which carries a wire-guiding system, made up of a hollow duct that directs the wire, running inside the flyer, until it is deposited on the loop, said deposition being regulated through a small revolving cage, arranged in the bottom part of the apparatus. From the operational point of view, from the association of the three speeds that embed the wire and more precisely the advancing speed of the wire, defined by the rotation speed of the capstans, the peripheral rotation speed of the flyer, linked to the diameter of the spiral to be obtained and to the speed itself of the capstans as well as the rotation speed of the small outer cage, a regular deposition of the wrapped wire is obtained. The invention shall be understood better through the description of one of its possible embodiments, only given as a non-limiting example, with the help of the attached tables of drawings, where:

Figure 1:
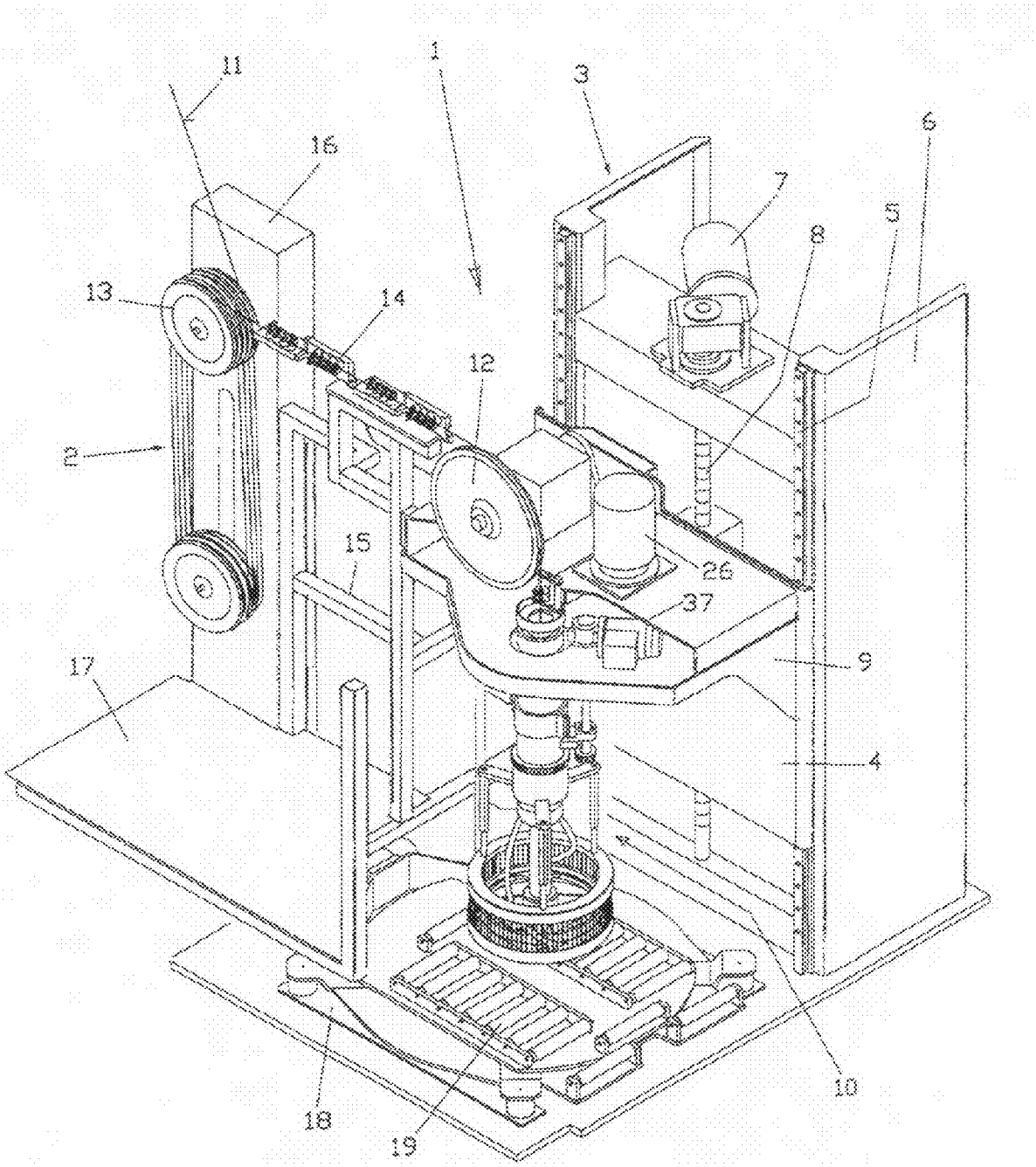
FIG. 1 (table I) represents a perspective view of the depositing apparatus according to the invention.
Figure 2:
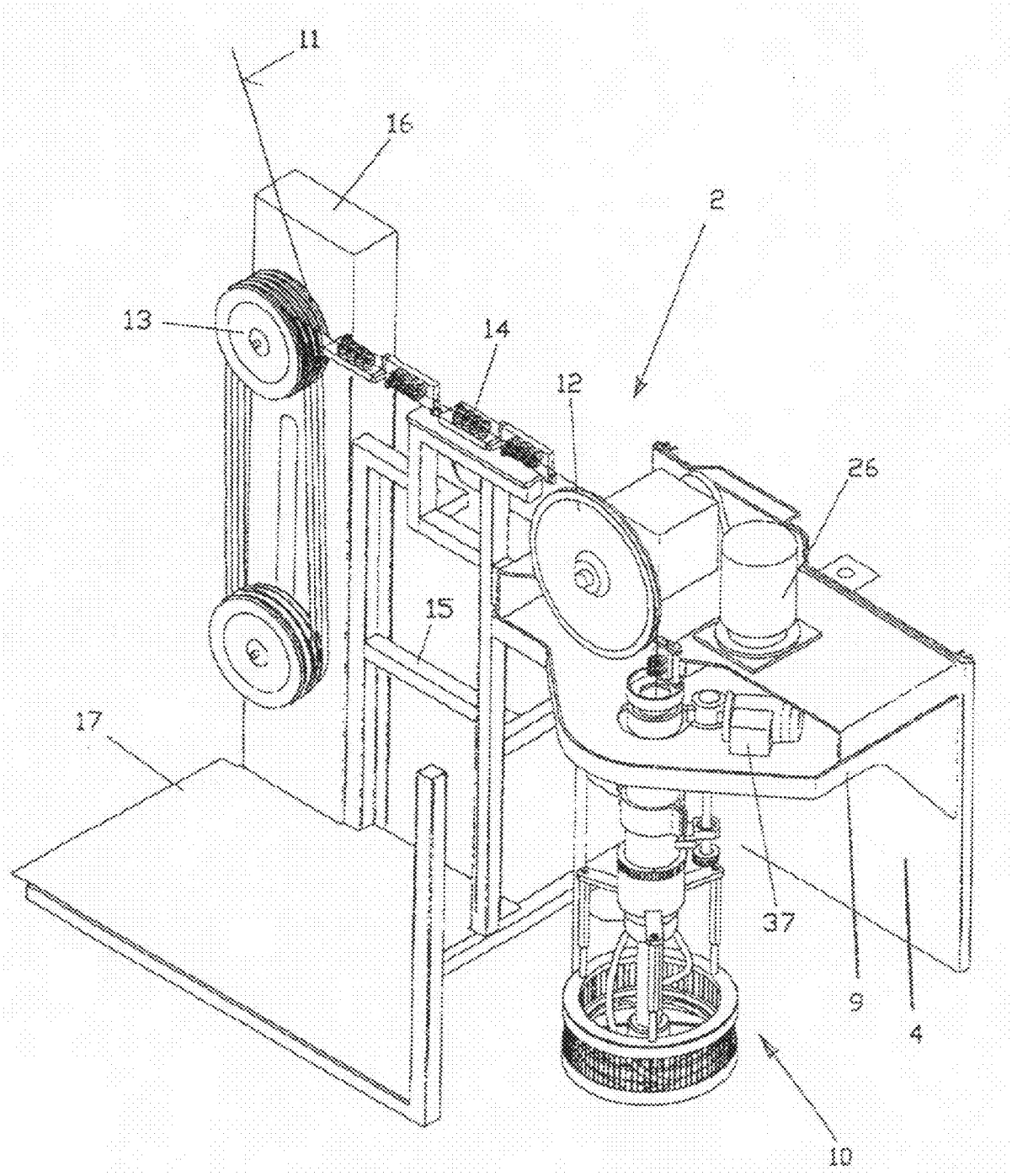
FIG. 2 (table II) represents a perspective view of the mobile part of the depositing apparatus according to FIG. 1.
Figure 3:
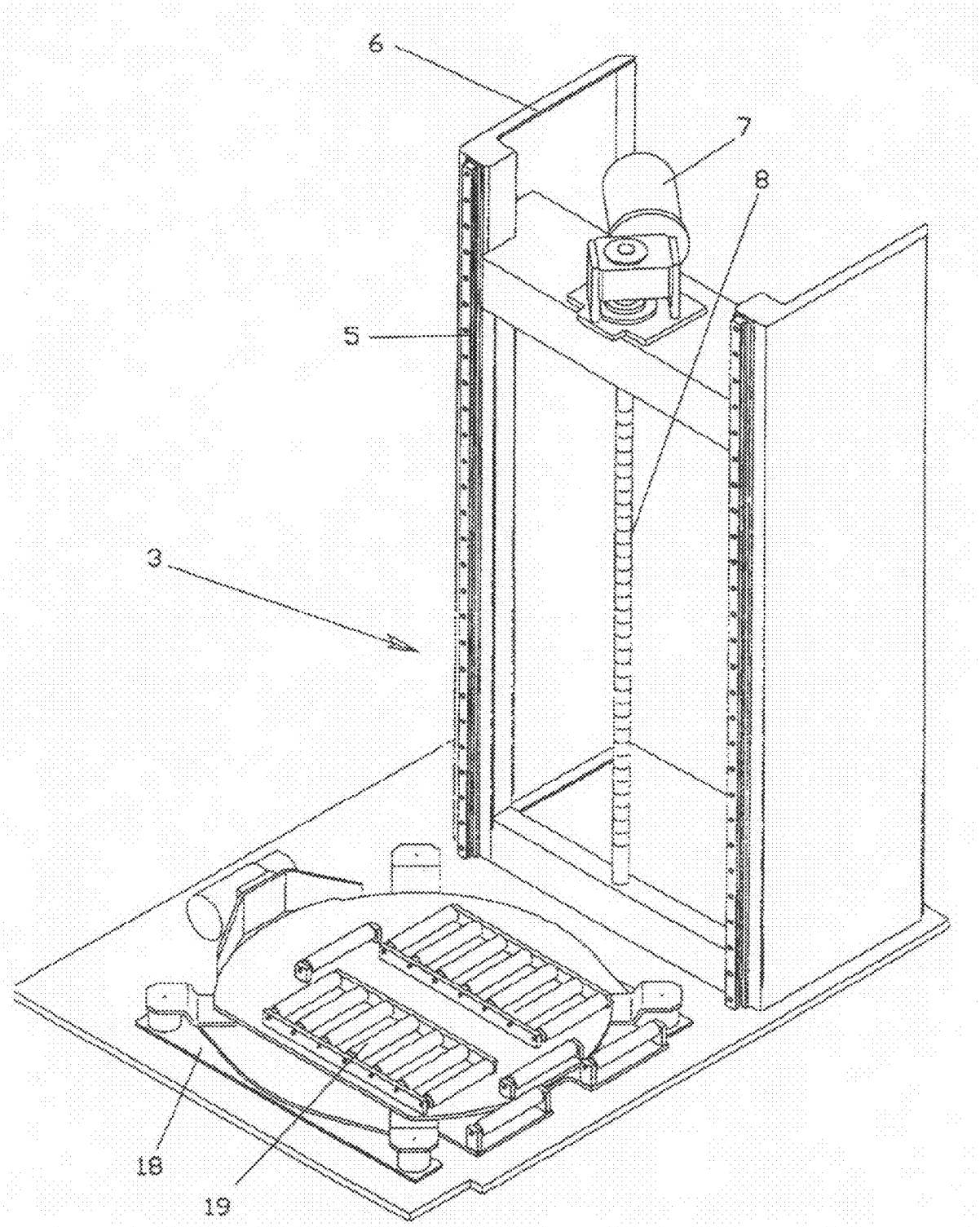
FIG. 3 (table II) represents a perspective view of the fixed part of the depositing apparatus according to FIG. 1.
Figure 4:
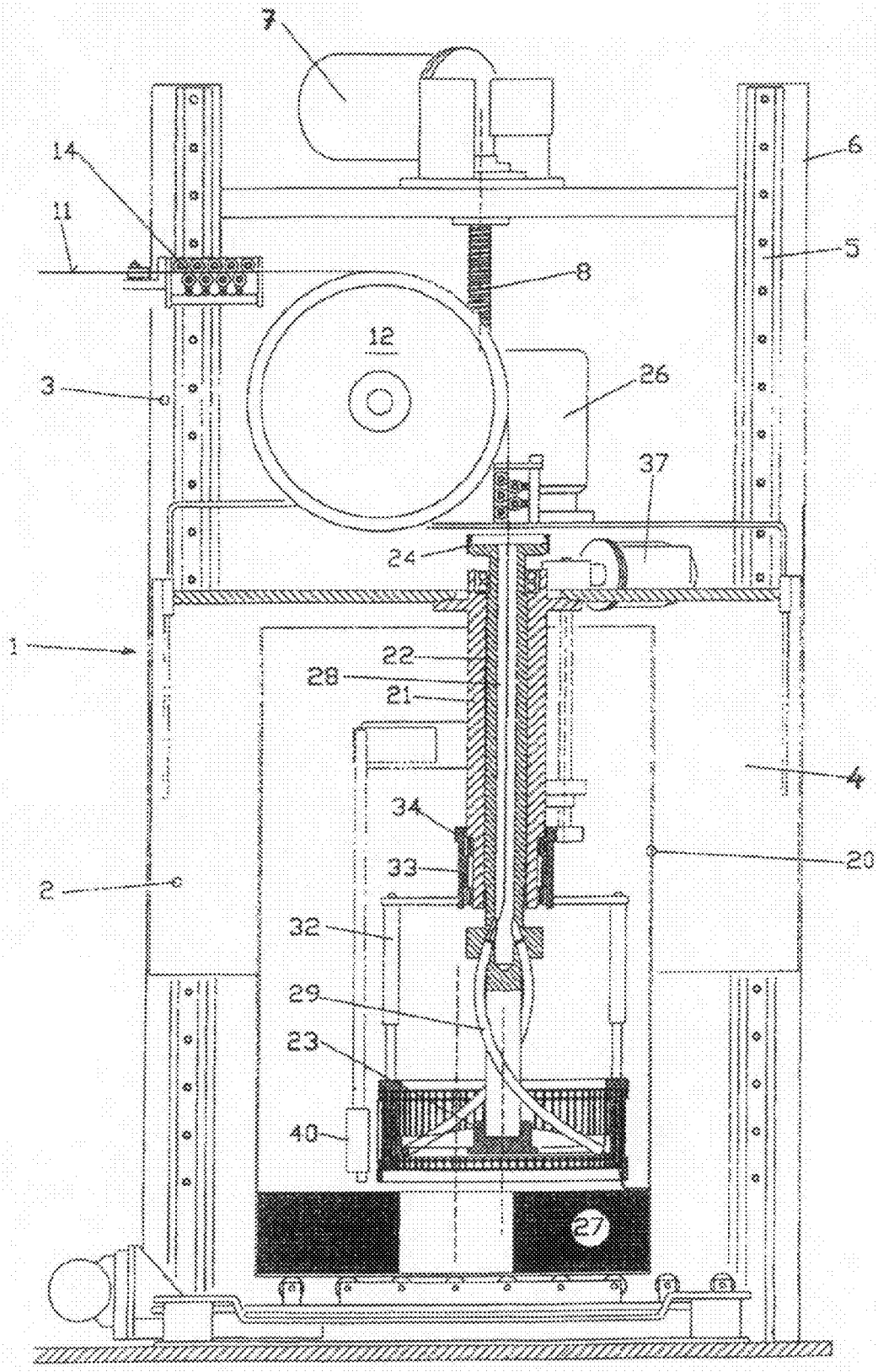
FIG. 4 (table IV) represents a sectioned front elevation view of the depositing apparatus according to FIG. 1.
Figure 5:
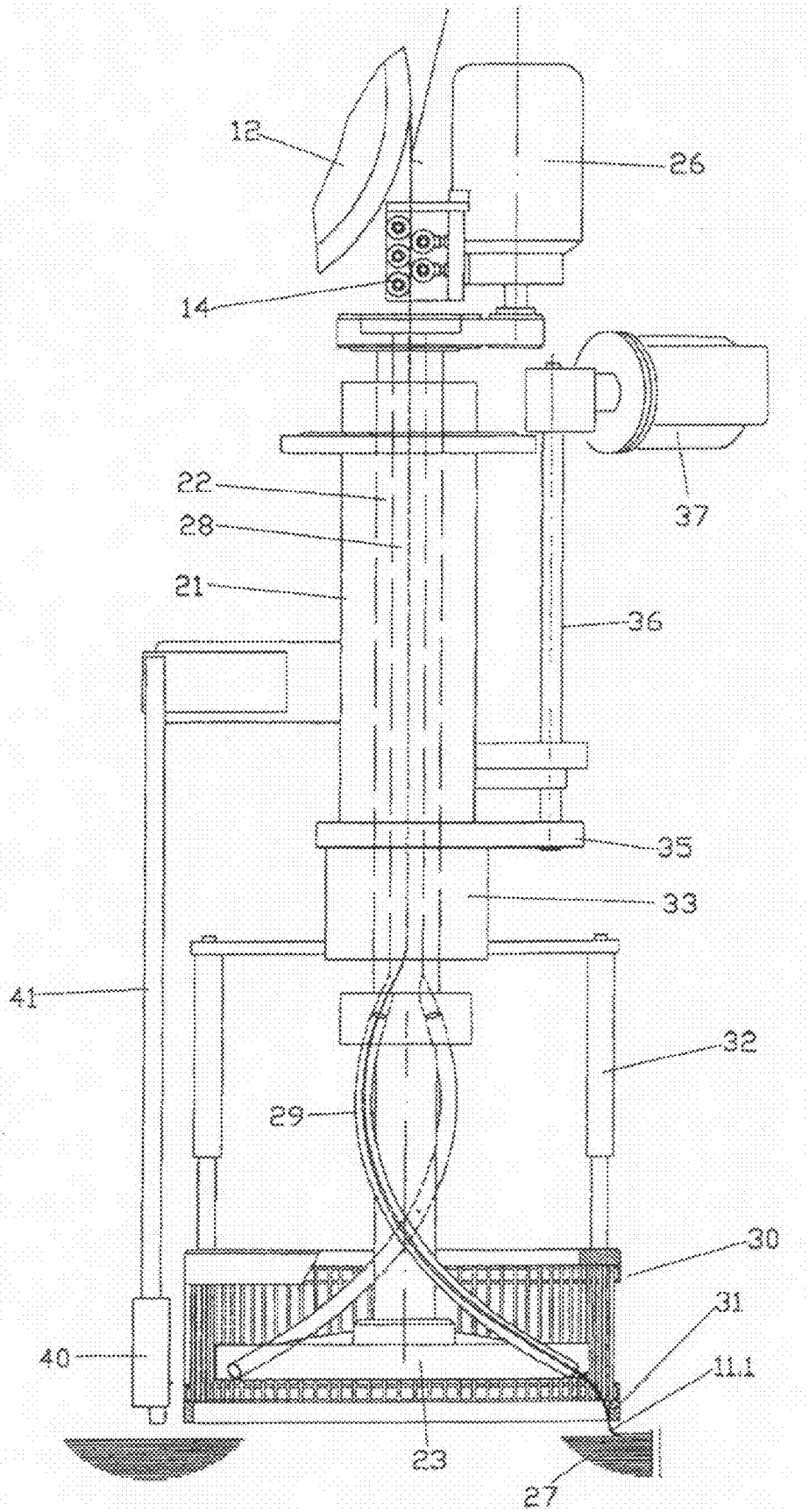
FIG. 5 (table V) represents a front elevation view of the flyer of the depositing apparatus according to FIG. 1.
Figure 6:
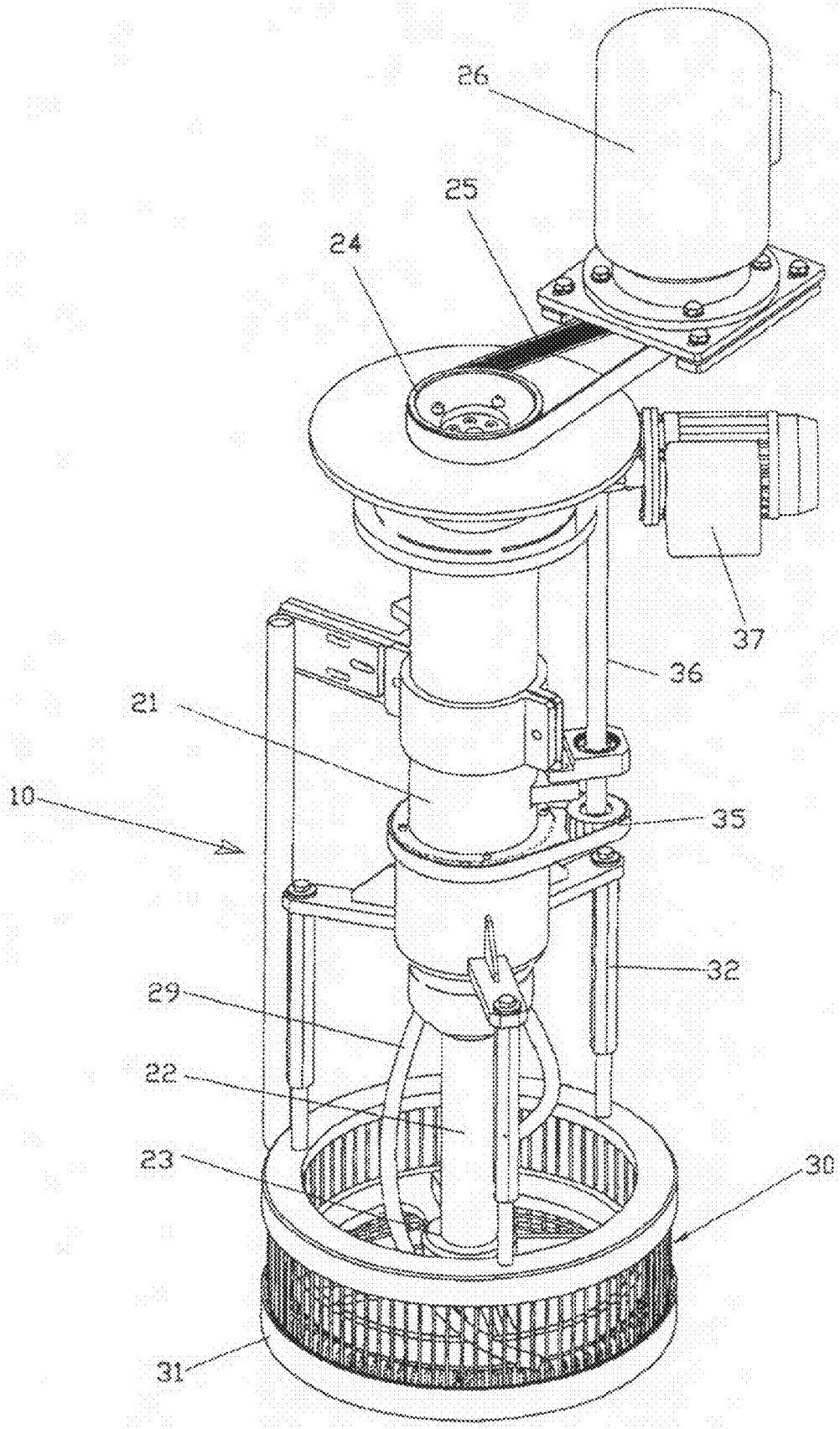
FIG. 6 (table VI) represents a constructive perspective view of the flyer according to FIG. 5.
Figure 7:
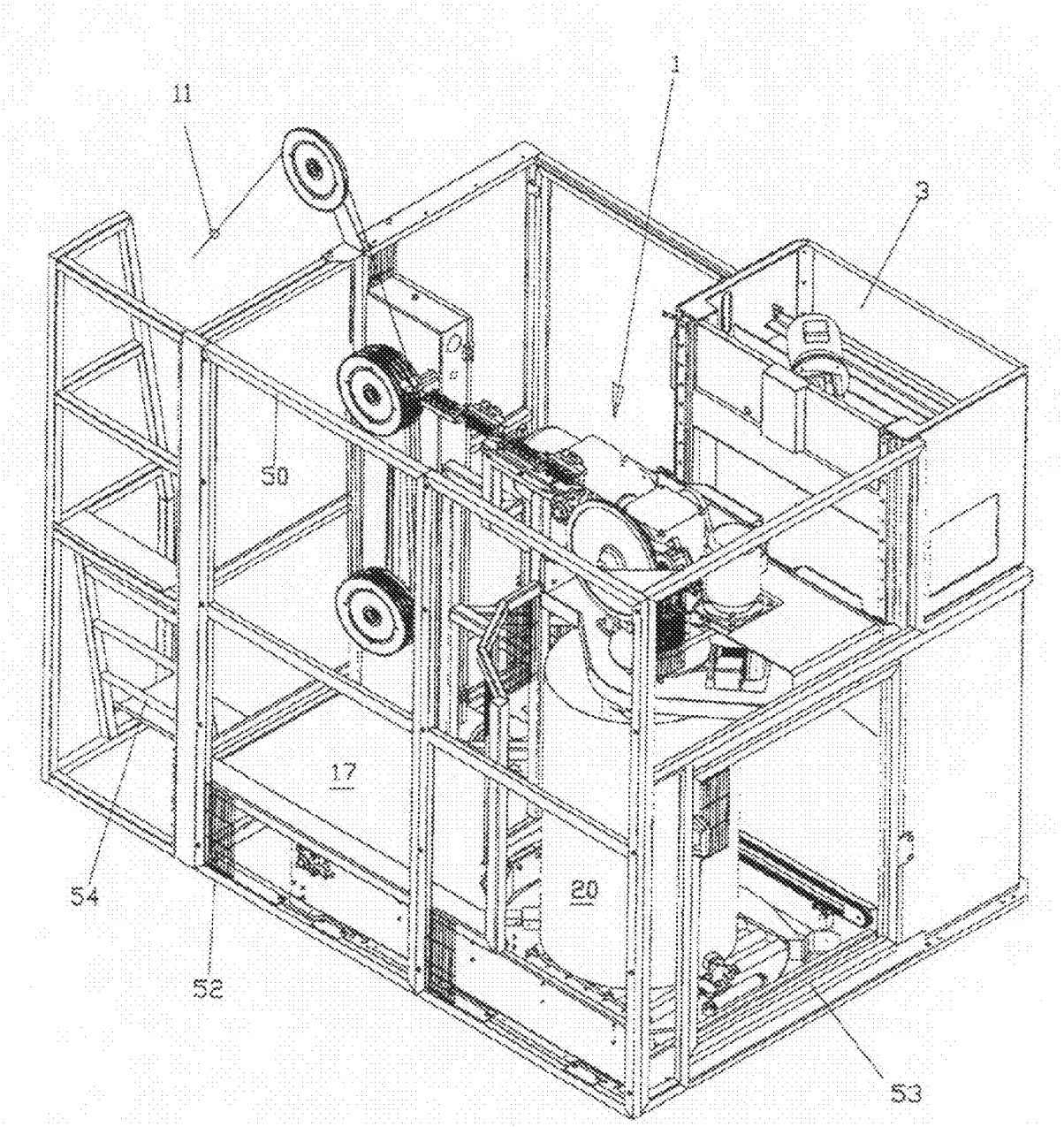
FIGS. 7, 8, 9 (tables VII-VIII-IX) represent perspective views, overall and side respectively, of a depositing apparatus according to the invention, in its preferred embodiment.
Figure 8:
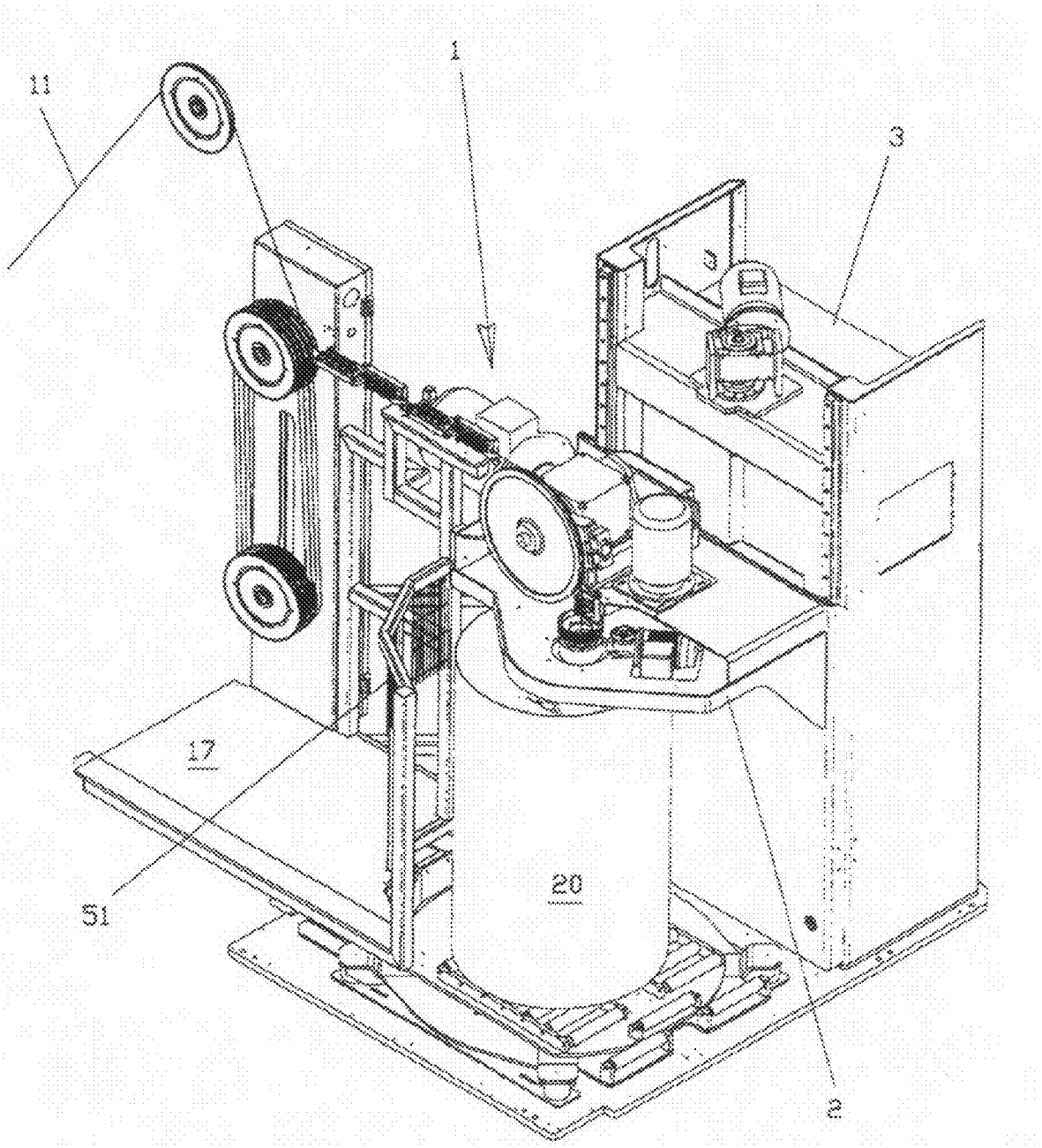
Figure 9:
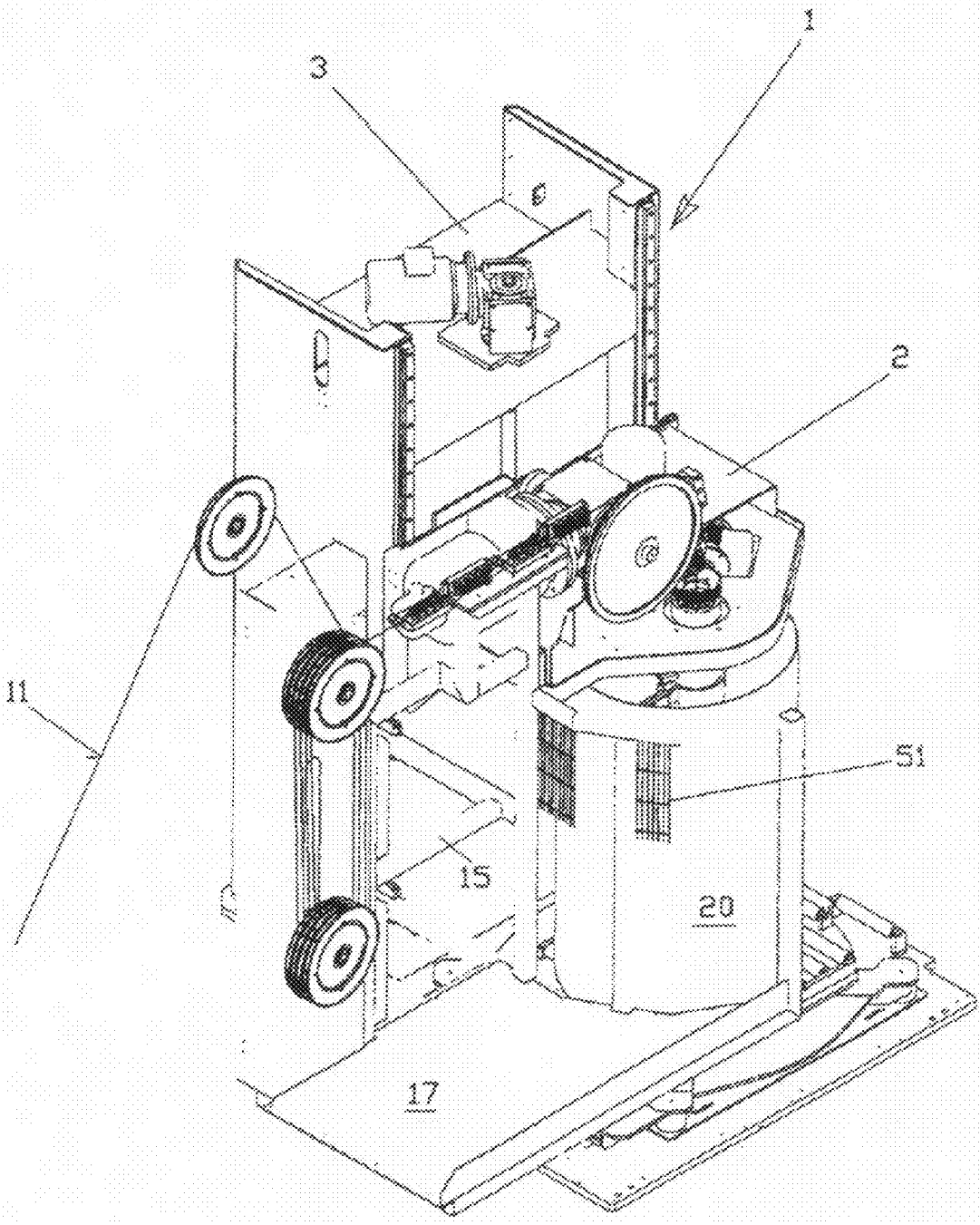

As can be seen in the attached figures, the depositing apparatus according to the invention, globally indicated with reference numeral 1, has a mobile part, globally indicated with reference numeral 2 and a fixed part, globally indicated with reference numeral 3, where the mobile part slides vertically, through the plate 4, on the guides 5, applied to the stops 6 of said fixed part and it is allowed to moved through the action of the motor 7, equipped with the threaded rod 8, the latter two elements being present on said fixed part. As can be seen in FIG. 2, the mobile part 2 has a console 9 that supports the flyer, globally indicated with reference numeral 10 and the group for driving the wire 11 that, in addition to the capstan 12, mounted on said console, has the revolving drum 13 and the series of wire directing apparatuses 14, supported through the framework 15, which supports the platform 17, which the operator uses when he has to intervene on said apparatuses. As can be seen in FIG. 3, the fixed part 3, in addition to the vertical stops 6, has the platform 18, equipped with the vibrating winding machine 19, above which the drum 20 is set. As can be seen in FIGS. 4 to 6, the flyer 10 has a hollow cylindrical body 21, which fixes to the console 9; inside the aforementioned body there is a casing 22, which ends at the bottom with a disc 23. The casing 22 is allowed to rotate through the top pulley 24 joined, through the belt 25, to the motor 26, applied to the fixed part 3. The revolving casing 22 performs the function of guiding the wire 11 from the capstan 12 up to the deposition on the loop 27, which progressively forms inside the drum 20. This wire-guiding function is achieved through a forced path for the wire 11, contained inside a flexible sheath, which foresees a first section, consisting of the hole 28, made coaxial on the casing 22 and which continues on the outside with a rigid tube 29, which comes out from said casing and which is locked on the inside in the peripheral surface of the bottom disc 23. As can be seen in FIG. 5, it is also foreseen for the wire 11, coming out from the end of the rigid tube 29, is contained inside a small cage 30, positioned outside of the disc 23. From the operational point of view, the effect of the centrifugal force, due to the rotation of the flyer, which is exerted on the portion of wire 11.1, which comes out from the tube 29, is opposed by the ring 31 of the small cage 30, against which said portion of wire strikes before depositing on the loop. Said small cage 30, supported through ties 32, forming a unit on the hub 33, applied to the cylindrical body 21, is also provided with a rotation movement, transmitted through the pulley 34, the belt 35 and the shaft 36 from the motor 37, applied to the fixed part 3. In particular, as soon as the rotating portion of wire 11.1 strikes against the rotating ring 31, due to the difference between the two speeds, that of the flyer and that of the small cage, a wire-accompanying action is obtained that promotes its regular deposition and ensures that the shape of the layers of wound wire remains constant and correct throughout the complete formation of the loop 27. The progressive lifting of the mobile group 2, from the inner position, with the drum empty, to keep the distance between the loop in the process of being formed and the bottom part of the flyer, is regulated through a sensor equipped with a photocell 40, supported by the stem 41, applied to the fixed cylindrical body 21, which detects the variation in increase in thickness of said loop. Finally, as can be seen in FIGS. 7 to 9, the depositing apparatus according to the invention, in its preferred embodiment, is enclosed inside a frame 50 equipped, in addition to the protective nets (the inside 51, which separates the space between the drum 20 and the platform 17 and the outside 52), on one side, with a door 53 for the manipulation (loading/unloading) of the drum; on the other hand, on the opposite side there is a ladder 54, which allows the operator to easily gain access to the mobile platform 17, as soon as it stops at different heights. Of course, embodiments different to those that have been described are also possible, according to the components used, without necessarily departing from the scope of the following claims.

The invention claimed is:

1. A wire depositing apparatus for deposition of wire wrapped in a loop, inside a drum, according to a rose or rose-formation configuration, said apparatus comprising:

a) a moveable part including a capstan for driving and drawing the wire taken from an unwinder disposed upstream of the apparatus, a series of wire rectifiers, and a flyer having a structure consisting of a casing supporting a wire-guiding system, said casing being equipped with a hollow duct that directs the wire running through the flyer until the wire is deposited on the loop, said deposition being regulated through a small revolving cage fitted in a bottom part of the flyer, said flyer having a rotational movement about a vertical axis of said flyer and a vertical reciprocating rectilinear movement so as to adapt to the progressive increase in thickness of the wrapped loop of wire inside said drum; and b) a stationary part including a first platform forming the bearing base for said first drum, said first platform remaining stationary in the lowest position and being aligned with said flyer.

2. The wire depositing apparatus according to claim 1, wherein the wire is manipulated by three speeds: the advancing speed, defined by the speed of rotation of the capstan, the peripheral rotation speed of the flyer, and the rotation speed of the small cage.

3. The wire depositing apparatus according to claim 1, wherein the movable part is adapted to slide vertically through a plate (4), on guides (5) mounted on stops (6) of said stationary part, said vertical movement being due to the action of a first motor (7), equipped with a threaded rod (8), said first motor and threshed rod being mounted on said stationary part.

4. The wire depositing apparatus according to claim 3, wherein said movable part (2) includes a console (9) supporting the flyer (10), said capstan (12), a revolving drum (13) and the series of wire rectifiers (14), said revolving drum (13) and rectifiers (14) being supported on a frame (15), which supports a mobile platform (17).

5. The wire depositing apparatus according to claim 4, wherein said flyer (10) includes a hollow fixed cylindrical body (21) forming a unit with said console (9), inside said hollow cylindrical body is a second casing (22) that guides the wire (11) contained in a flexible sheath of the capstan (12) until deposition on the loop which is progressively formed inside the drum (20).

6. The wire depositing apparatus according to claim 5, wherein said second casing (22) terminates at a bottom disc (23), said second casing being rotated by means of a top pulley (24) driven through a first belt (25) by a second motor (26) mounted on said stationary part.

7. The wire depositing apparatus according to claim 6, wherein the wire-guiding system includes a forced path of the wire (11) consisting, in a first section, of a coaxial hole (28) formed in the second casing (22) which continues with a rigid tube (29) which exits said second casing and which is locked at the bottom in the peripheral surface of the bottom disc (23).

8. The wire depositing apparatus according to claim 7, wherein the wire (11), exiting from the end of the rigid tube (29), is contained inside said small revolving cage (30), positioned outside the disc (23).

9. The wire depositing apparatus according to claim 7, wherein the advancement of the portion of the wire exiting from the rigid tube (29) is opposed by a ring (31) of the small revolving cage (30), against which it strikes before depositing on the loop.

10. The wire depositing apparatus according to claim 9, wherein the small revolving cage (30) is supported through ties (32) forming a unit with a hub (33) applied to the cylindrical body (21), the rotational movement of said small revolving cage (30) is transmitted through a second pulley (34), a second belt (35) and a shaft (36) from a third motor (37), mounted on said stationary part.

11. The wire depositing apparatus according to claim 10, wherein the peripheral rotational speed of the small revolving cage (30) differs from the rotational speed of the flyer, or of the second casing (22), so that as soon as the revolving portion of the wire strikes against the revolving ring (31), a driving action is obtained on the wire itself.

12. The wire depositing apparatus according to claim 11, wherein the progressive lifting of the movable part from the bottom position with the drum empty, to keep the distance between the loop being formed and the bottom part of the flyer constant, is regulated through a sensor equipped with a photocell (40), supported through a stem (41), mounted to the fixed cylindrical body (21), which detects the variation in terms of increase in thickness of said loop.

13. The wire depositing apparatus according to claim 12, wherein the apparatus is enclosed inside a frame (50) equipped on an inside (51) which separates the space between the drum (20) and the mobile platform (17) on one of its sides, with a door (53), for the insertion and removal of the drum and, on an opposite side, with a ladder (54), that allows an operator to have easy access to the mobile platform (17).

14. The wire depositing apparatus according to claim 3, wherein said stationary part includes the stops (6) and the first platform (18), equipped with a vibrating rolling machine (19), on which said drum is set.

* * * * *

UNITED STATES PATENT AND TRADEMARK OFFICE

CERTIFICATE OF CORRECTION

PATENT NO. : 7,971,819 B2
APPLICATION NO. : 11/989149
DATED : July 5, 2011
INVENTOR(S) : Marangoni It is certified that error appears in the above-identified patent and that said Letters Patent is hereby corrected as shown below:

In particular, on the Title page, Column 1, item [30], please change "VI2005A0215" to correctly read: --VI2005A000215--.

Signed and Sealed this
Sixteenth Day of August, 2011

David J. Kappos

David J. Kappos
*Director of the United States Patent and Trademark Office*